United States Patent [19]

Mennuto

[11] Patent Number: 4,953,258

[45] Date of Patent: Sep. 4, 1990

[54] BALANCING ARRANGEMENT FOR DOUBLE HUNG WINDOWS

[75] Inventor: Anthony R. Mennuto, Paramus, N.J.

[73] Assignee: Metal Industries, Inc., Elizabethville, Pa.

[21] Appl. No.: 377,327

[22] Filed: Jul. 10, 1989

[51] Int. Cl.[5] ..... E05F 1/02

[52] U.S. Cl. ..... 16/197; 16/193

[58] Field of Search ..... 16/197, 199, 193, DIG. 16, 16/DIG. 20, 1 C

[56] References Cited

U.S. PATENT DOCUMENTS

| | | | |
|---|---|---|---|
| 403,479 | 5/1889 | McArthur | 16/DIG. 16 |
| 1,760,226 | 5/1930 | Appleby | 16/193 |
| 2,644,193 | 7/1953 | Anderberg | 16/197 |
| 2,670,198 | 2/1954 | Glaser et al. | 16/197 |
| 2,732,594 | 1/1956 | Adams et al. | 16/197 |
| 2,817,872 | 12/1957 | Foster | 16/197 |
| 2,873,472 | 2/1959 | Foster | 16/197 |
| 3,992,751 | 11/1976 | Foster et al. | 16/197 |

*Primary Examiner*—Richard K. Seidel
*Assistant Examiner*—James Miner
*Attorney, Agent, or Firm*—Anthony F. Cuoco

[57] ABSTRACT

A balancing arrangement for double hung windows is disclosed including a spring arrangement supported by a spring holder installed in a window jamb and a balance shoe installed in a window sash. A leaf spring is supported to engage a detent in the balance shoe installed in the top window sash, whereby displacement of the top sash when closed is prevented to maintain the seal between the bottom and top sashes at the horizontal center of the window when the bottom sash is lowered for closing against the compression force of a weather stripping seal at the horizontal center. The opening of the top sash is unaffected, other than a slightly greater force being required to bypass the leaf spring and detent arrangement.

9 Claims, 2 Drawing Sheets

BALANCING ARRANGEMENT FOR DOUBLE HUNG WINDOWS

BACKGROUND OF THE INVENTION

Double hung windows feature a balancing arrangement to counter the weight of the window sashes, thereby permitting a user to position the sashes at a desired opened height. The balancing arrangement also enables the user to open and close the windows with minimum exertion.

Traditionally the aforenoted counter balancing has been accomplished via a pulley, weight and rope arrangement. In modern double hung windows the pulley, weight and rope arrangement has been replaced by a spring arrangement of one type or another. A "constant force" spring arrangement is commonly used.

An important feature of modern double hung windows is the weather stripping which seals against seepage of hot and cold air. One of the prime locations for a weather stripping seal is the horizontal center of the window, i.e. where the bottom of the top and the top of the bottom window sashes meet.

Most weather stripping seals are of a flexible material and the compression of the material provides the seal. It has been found that compression of the weather stripping material can require a force greater than the balancing force needed for raising and lowering the window sashes. Accordingly, when the bottom sash is raised to a venting position and the user desires to lower the sash to close the window, the force required for compressing the weather stripping at the meeting rail, i.e. the horizontal center of the window, displaces the top sash downward, causing a poor seal and also causing poor alignment of the sash locks.

The invention herein disclosed overcomes this problem by incorporating a leaf spring and detent into the window balancing arrangement associated with at least the top sash, whereby the aforenoted displacement of the sash is prevented and the effectivity of the weather stripping seal is maintained.

SUMMARY OF THE INVENTION

This invention contemplates a balancing arrangement for a double hung window. The balancing arrangement features spring means supported by a spring holder installed in a window jamb. A balance shoe is installed on a window sash. In the balancing arrangement associated with at least the top window sash a leaf spring is supported to engage a detent so as to prevent displacement of the top sash downward when the bottom sash is lowered for closing against the force of a weather stripping seal at the horizontal center of the window. The balancing arrangement is such that the normal opening of the top sash is unaffected except for a slightly greater force required to bypass the detent and leaf spring arrangement.

DETAILED DESCRIPTION OF THE INVENTION

Figure 1:
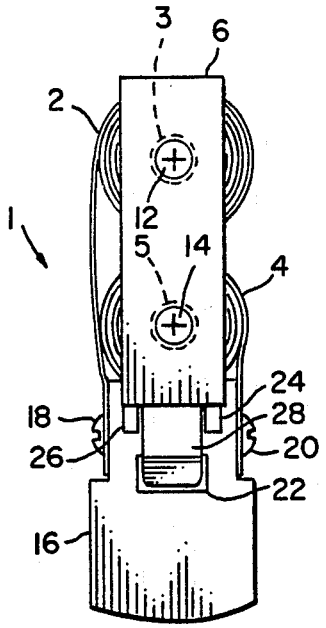
FIG. 1 is a diagrammatic front view representation showing the components of the invention.

With reference to FIGS. 1–4 the balancing arrangement of the invention is designated by the numeral 1 and includes an upper linear coil ribbon spring 2 and a lower linear coil ribbon spring 4. Springs 2 and 4 are supported by a spring holder 6. The wound portion of spring 2 surrounds a slip bushing 8 and the wound portion of spring 4 is surrounds a slip bushing 10. Slip bushings 8 and 10 are supported on spools 3 and 5 respectively, which are integral with spring holder 6. A screw or the like 12 extends through spool 3. Likewise, a screw or the like 14 extends through spool 5.

With particular reference to FIG. 1, an end of linear coil ribbon spring 2 is secured to one side of a balance shoe 16 via a screw or the like 18 and an end of linear coil ribbon spring 4 is secured to the opposite side of balance shoe 16 via a screw or the like 20. Balance shoe 16 includes a detent 22 formed thereon. Balance shoe 16 includes a pair of stops 24 and 26, and which stops are in spaced relation to each other on either side of detent 22.

Figure 2:
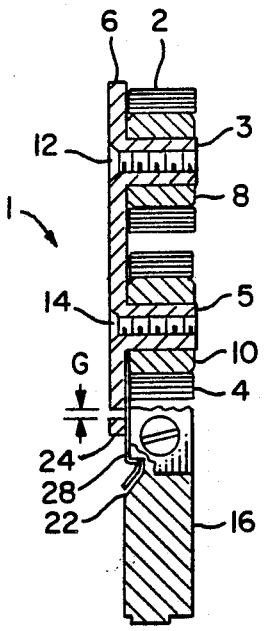
FIG. 2 is a sectioned diagrammatic side view representation showing a balance shoe with a detent and a leaf spring engaged in the detent in accordance with the invention.
Figure 3:
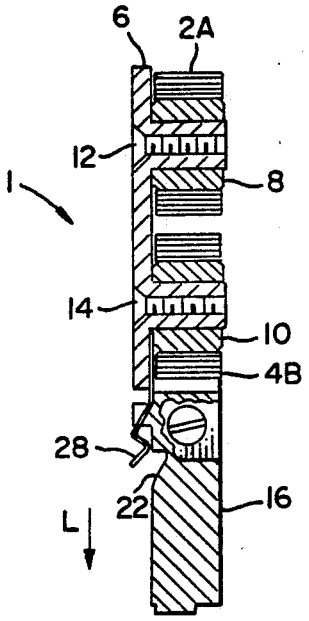
FIG. 3 is a sectioned diagrammatic side view representation showing the relation between the components of the invention when the balance shoe is displaced downward so that the leaf spring will disengage the detent.
Figure 4:
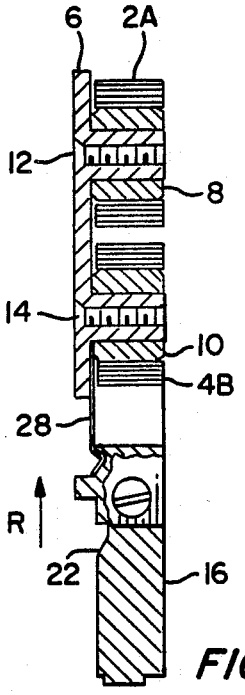
FIG. 4 is a sectioned diagrammatic representation showing the relation of the components of the invention when the balance shoe is displaced upward so that the leaf spring will engage the detent.

A leaf spring 28 is sandwiched between spring holder 16 and slip bushing 10 surrounded by torsion spring 4 and extends below the top of spring holder 16 as best shown in FIGS. 2, 3 and 4.

FIGS. 1 and 2 are particularly illustrative of balancing arrangement 1, wherein balance shoe 16 is in a position so that leaf spring 28 engages detent 22. With particular reference to FIG. 2, a gap G of approximately 0.060 inches, for example, occurs between the bottom of spring holder 6 and stops 24 and 26 when leaf spring 28 engages detent 22. Gap G allows for manufacturing tolerances in connection with the engagement of leaf spring 28 in detent 22, as will now be understood.

With particular reference to FIG. 3, balancing arrangement 1 is shown when balance shoe 16 is displaced downward as shown by arrow L. That is to say, leaf spring 28 is disengaging detent 22.

With particular reference to FIG. 4, balancing arrangement 1 is shown when balance shoe 16 is displaced upward as shown by arrow R. That is to say, spring 28 is about to engage detent 22 to serve the purposes of the invention.

Figure 5:
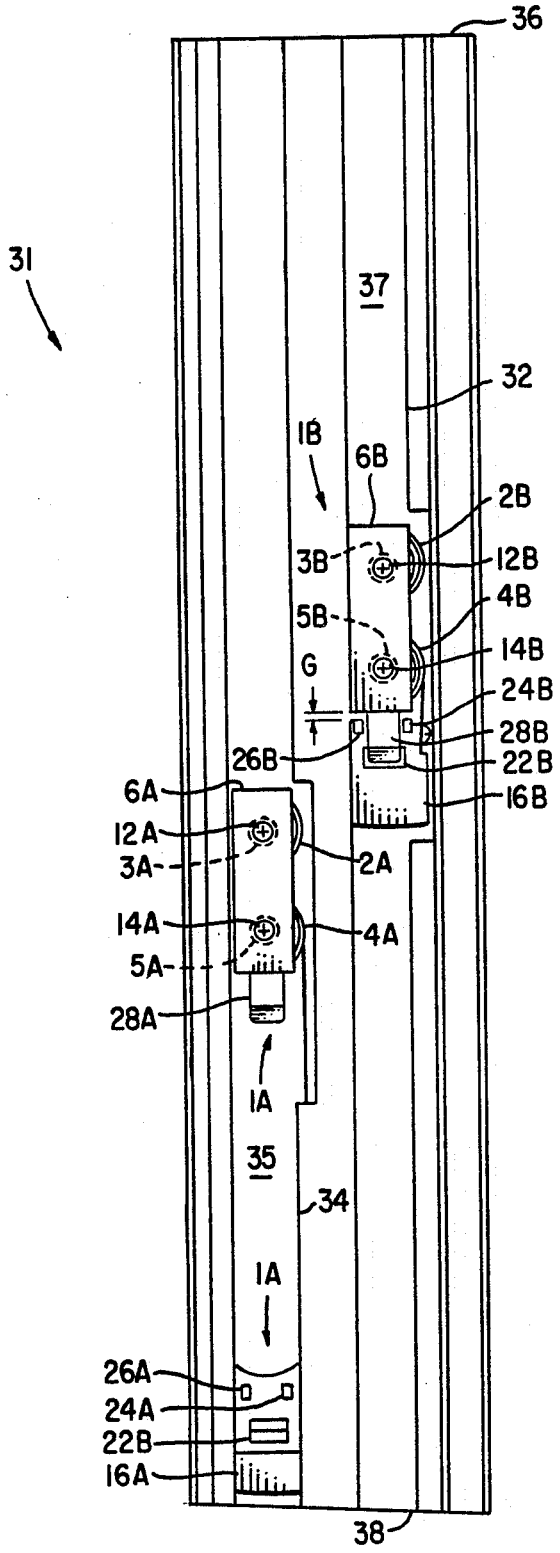
FIG. 5 is a diagrammatic front view representation showing the invention installed in the window jambs and sashes of a double hung window and further showing the relation of the components of the invention when the window is closed.

With particular reference to FIG. 5, a top sash of a double hung window 31 is designated by the numeral 32 and a bottom sash of said window is designated by the numeral 34. Window 32 is shown closed. That is to say, top sash 32 abuts window jamb head end 36 and bottom sash 34 abuts window jamb sill end 38. Each of the top and bottom sashes and jambs have installed therein a balance arrangement such as illustrated and described with reference to FIGS. 1–4. For purposes of further explaining the invention, the balancing arrangement installed in bottom sash 34 and a corresponding jamb 35 will carry the same numerical designations as shown in FIGS. 1–4 but with the subscript A, and the balancing arrangement installed in top sash 32 and a corresponding jamb 37 will carry like numerical designations but with the subscript B.

Thus, a balancing arrangement 1A has a spring holder 6A installed in bottom sash jamb 35 via screws 12A and 14A extending through spools 3A and 5A of spring holder 6A and into the jamb. A balance shoe 16A is suitably affixed to bottom sash 34 so as to be displaced therewith. Likewise, a balancing arrangement 1B has a spring holder 16B installed in top sash jamb 37 via screws 12B and 14B extending through spools 3B and 5B of spring holder 6B and into the jamb. A balance shoe 16B is suitably affixed to top sash 32 so as to be displaced therewith. Spring holder 6A is installed near the top of bottom sash jamb 35 and spring holder 6B is installed near the bottom of top sash jamb 37.

With window 31 closed as shown in FIG. 5, balance shoe 16A is at jamb sill end 38. Spring holder 6A is at the top of bottom sash 35 and torsion springs 2A and 4A are extended.

The bottom of spring holder 6B is separated from stops 24B and 26B by the aforenoted gap G and leaf springs 28B engages detent 22B. Linear coil ribbon spring 2B and 4B are unextended. It will be recognized from the several Figures herein shown, that the tops of balance shoes 16A and 16B are concave to receive the unwound portions of the respective linear coil ribbon springs 4A and 4B, as the case may be.

It will now be recognized that when bottom sash 34 is raised as in a venting position, and the user wishes to close the bottom sash to a position as illustrated in FIG. 5, the force required for compressing the aforenoted seal between top sash 32 and bottom sash 35 at the horizontal center of the window will be prohibited from forcing top sash 32 downward by the cooperative action of leaf spring 28B engaging detent 22B, whereby the effectivity of the seal is maintained.

The invention in no way affects the normal opening of top sash 32, other than a slightly greater force being required to bypass the detent and leaf spring arrangements.

It will be understood that the jambs and sashes on each side of window 31 will carry a balancing arrangement as herein disclosed, although the invention has been shown and described with relation to only one side of the window for purposes of simplicity. It will also be understood that for the intended purpose of the invention as aforenoted detent 22 and leaf spring 28 are not required on bottom balancing arrangement 1A, although for production and marketing purposes identical balancing arrangements 1A and 1B may be desirable.

Further, the invention has been described as using two linear coil ribbon springs such as 2 and 4. Depending on the application involved, only one such spring may suffice to serve the purposes of the invention. Indeed, while linear coil ribbon spring arrangements have been shown and described, other type spring arrangements may be used as well.

There has thus been described a balancing arrangement for double hung windows which is an improvement over the traditional pulley, weight and rope arrangement. The improved arrangement accommodates the force needed for lowering the bottom sash against the compression force of a weather stripping seal while maintaining the effectivity of the seal between the top and bottom sashes at the horizontal center of the window.

With the above description of the invention in mind reference is made to the claims appended hereto for a definition of the scope of the invention.

What is claimed is:

1. A balancing arrangement for a double hung window, including means for preventing displacement of a closed upper window sash downwardly when an opened lower window sash is displaced downwardly against a sealing force at the horizontal center of the window, comprising:

first spring means secured to a jamb on one side of the upper sash and second spring means secured to a jamb on the other side of the upper sash;

first balance shoe means secured to the one side of the upper sash and second balance shoe means secured to the other side of the upper sash;

each of the first and second spring means including a spring arrangement secured to a corresponding one of the first and second balance shoe means, and including means for supporting the spring arrangement;

each of the first and second balance shoe means having a detent; and each of the means for supporting the spring arrangement supporting means for engaging a corresponding detent when the upper window sash is closed and the spring arrangement is unextended, whereupon the closed upper sash is prevented from being displaced downwardly when the lower sash is displaced downwardly against the sealing force at the horizontal center.

2. A balancing arrangement for a double hung window as described by claim 1, wherein the spring arrangement includes a pair of linear coil ribbon springs and the means for supporting the spring arrangement includes:

a spring holder;

a pair of spools integral with the spring holder, said spools being aligned with, and in longitudinal spaced relation to, each other;

a pair of slip bushings, each of which surrounds a corresponding spool;

each of the pair of linear coil ribbon springs surrounding a corresponding slip bushing, with the end of one of the springs being on one side of the spring holder and the end of the other of the springs being on the other side of the spring holder;

the end of the one of the springs being secured to one side of the corresponding one of the first and second balance shoe means; and the end of the other of the springs being secured to the other side of the corresponding one of the first and second balance shoe means.

3. A balancing arrangement for a double hung window as described by claim 2, wherein:

the means for engaging the corresponding detent includes leaf spring means; and the leaf spring means being supported by the means for supporting the spring arrangement by being sandwiched between the spring holder and a slip bushing so as to extend below the spring holder.

4. A balancing arrangement for a double hung window, comprising:

first spring means secured to a jamb on one side of an upper window sash;

second spring means secured to a jamb on the other side of the upper window sash;

third spring means secured to a jamb on one side of a lower window sash;

fourth spring means secured to a jamb on the other side of the lower window sash;

first balance shoe means secured to the one side of the upper window sash;

second balance shoe means secured to the other side of the upper window sash;

third balance shoe means secured to the one side of the lower window sash;

fourth balance shoe means secured to the other side of the lower window sash;

each of the first, second, third and fourth spring means including a spring arrangement secured to a corresponding one of the first, second, third and fourth balance shoe means, and including means for supporting the spring arrangement;

at least each of the first and second balance shoe means having a detent; and at least the means for supporting the spring arrangements included in the first and second spring means supporting means for engaging a corresponding detent when the upper window sash is closed and the spring arrangements included in the first and second spring means are unextended, whereupon the closed upper sash is prevented from being displaced downwardly when the lower sash is displaced downwardly against a sealing force at the horizontal center of the window and the spring arrangements included in the third and fourth spring means are extended.

5. A balancing arrangement for a double hung window as described by claim 4, wherein each of the spring arrangements includes a pair of linear coil ribbon springs and the means for supporting the spring arrangements includes:

a spring holder;

a pair of spools integral with the spring holder, said spools being aligned with, and in longitudinal spaced relation to, each other;

a pair of slip bushings, each of which surrounds a corresponding spool;

each of the pair of linear coil ribbon springs surrounding a corresponding slip bushing, with the end of one of the springs being on one side of the spring holder and the end of the other of the springs being on the other side of the spring holder;

the end of the one of the springs being secured to one side of the corresponding one of the first and second balance shoe means; and the end of the other of the springs being secured to the other side of the corresponding one of the first and second balance shoe means.

6. A balancing arrangement for a double hung window as described by claim 5, wherein:

the means for engaging a corresponding detent includes leaf spring means; and the leaf spring means being supported by the means for supporting the spring means included in the first and second spring arrangements by being sandwiched between the spring holder and a slip bushing so as to extend below the spring holder.

7. A balancing arrangement for use with a double hung window, comprising:

spring means secured to a window jamb;

balance shoe means secured to a corresponding window sash;

the spring means including a spring arrangement secured to the balance shoe means, and including means for supporting the spring arrangement;

the balance shoe means having a detent; and the means for supporting the spring arrangement supporting means for engaging the detent when the spring arrangement is unextended.

8. A balancing arrangement for use with a double hung window as described by claim 7, wherein the spring arrangement includes a pair of linear coil ribbon springs and the means for supporting the linear coil ribbon springs includes:

a spring holder;

a pair of spools integral with the spring holder, said spools being aligned with, and in longitudinal spaced relation to, each other;

a pair of slip bushings, each of which surrounds a corresponding spool;

each of the pair of linear coil ribbon springs surrounding a corresponding slip bushing, with the end of one of the springs being on one side of the spring holder and the end of the other of the springs being on the other side of the spring holder;

the end of the the one of the springs being secured to one side of the corresponding one of the first and second balance shoe means; and the end of the other of the springs being secured to the other side of the corresponding one of the first and second balance shoe means.

9. A balancing arrangement for use with a double hung window as described by claim 8, wherein:

the means for engaging the detent includes leaf spring means; and the leaf spring means being supported by the means for supporting the spring arrangement by being sandwiched between the spring holder and a slip bushing so as to extend below the spring holder.

* * * * *